US008390536B2

(12) United States Patent
Troccoli et al.

(10) Patent No.: US 8,390,536 B2
(45) Date of Patent: Mar. 5, 2013

(54) ACTIVE MATRIX DISPLAY AND METHOD

(76) Inventors: Matias N Troccoli, Lower Saucon Township, PA (US); Miltiadis K Hatalis, Bethlehem, PA (US)

( * ) Notice: Subject to any disclaimer, the term of this patent is extended or adjusted under 35 U.S.C. 154(b) by 1480 days.

(21) Appl. No.: 11/608,881

(22) Filed: Dec. 11, 2006

(65) Prior Publication Data

US 2008/0136338 A1 Jun. 12, 2008

(51) Int. Cl.
*G09G 3/16* (2006.01)

(52) U.S. Cl. ..... 345/48; 345/55; 345/84; 345/90; 313/498

(58) Field of Classification Search ..... 345/36–39, 345/44–48, 76–82, 690, 210–215; 313/498
See application file for complete search history.

(56) References Cited

U.S. PATENT DOCUMENTS

| | | | | |
|---|---|---|---|---|
| 5,892,504 | A | 4/1999 | Knapp | |
| 5,952,789 | A | 9/1999 | Stewart | |
| 6,452,341 | B1 | 9/2002 | Yamauchi | |
| 6,618,030 | B2 | 9/2003 | Kane | |
| 6,943,500 | B2 | 9/2005 | LeChevalier | |
| 6,975,293 | B2 | 12/2005 | Yen | |
| 6,995,737 | B2 | 2/2006 | LeChevalier | |
| 7,019,720 | B2 * | 3/2006 | LeChevalier | 345/82 |
| 7,050,024 | B2 * | 5/2006 | LeChevalier | 345/84 |
| 7,079,130 | B2 | 7/2006 | LeChevalier | |
| 7,079,131 | B2 | 7/2006 | LeChevalier | |
| 7,119,784 | B2 | 10/2006 | Koyama | |
| 2004/0178407 | A1 * | 9/2004 | Lin | 257/40 |
| 2004/0217932 | A1 | 11/2004 | Nally | |
| 2004/0257314 | A1 | 12/2004 | Chang | |
| 2005/0017965 | A1 | 1/2005 | Morita | |
| 2005/0062508 | A1 | 3/2005 | Nishimura | |
| 2005/0067971 | A1 | 3/2005 | Kane | |
| 2005/0110726 | A1 | 5/2005 | Shin | |
| 2005/0134536 | A1 | 6/2005 | Lo | |
| 2005/0247932 | A1 | 11/2005 | Huang | |
| 2005/0259490 | A1 | 11/2005 | Eom | |

(Continued)

FOREIGN PATENT DOCUMENTS

WO 2005029456 A1 3/2005

OTHER PUBLICATIONS

G. Bodammer, A. Buckley, D. Burns, C. Giebeler, J. Goorlay, A. Graham, M. Newsam, R. Monteith, D. Nicol, P. Parmier, D. Steven. 1. Undemood, C. Wilkinson, S. Whitelegg, R. Woodburn, J. Wright, Emissive Microdisplay using light Emitting Polymer, S/D Digest, p. 742-745 (2003 Edinburgh, Scotland).

(Continued)

*Primary Examiner* — Amare Mengistu
*Assistant Examiner* — Vinh Lam
(74) *Attorney, Agent, or Firm* — Rhoads & Sinon, LLP; Kurt L. Ehresman

(57) ABSTRACT

An active matrix display includes at least one data driver circuit comprising a column data line and a parallel column current line; a plurality of pixels connected in series to both the column data line and the parallel column current line comprising at least one pixel that is responsive to the column data line to drive a selected pixel current to the at least one pixel; and a loopback control circuit at the head of the column and external to the plurality of pixels that senses a voltage difference between an input column current in the current line and a voltage of a load drawing on the current line and that adjusts a data programming voltage according to the difference.

17 Claims, 4 Drawing Sheets

U.S. PATENT DOCUMENTS

| | | | | |
|---|---|---|---|---|
| 2006/0054893 | A1 | 3/2006 | Nathan | |
| 2006/0066555 | A1* | 3/2006 | Miyagawa | 345/100 |
| 2006/0170628 | A1 | 8/2006 | Yamashita et al. | |
| 2006/0244695 | A1 | 11/2006 | Komiya | |

OTHER PUBLICATIONS

D. Fish, N. Young, M. Childs, W. Steer, D. George, D. McCullough, S. Godfrey, H. Troccoli, M. Johnson, A. Giraldo and H. Lifka, *A Comparison of Pisei Circuits for Active Matrix Polymer/Organic LED Displays*, SID 02 Digest 968 (2002).

Goh, Kim and Jang, A Novel Pixel Circuit for Active-Matrix Organic Lighe-Emitting Diodes, S/D 03 Digest, pp. 494-497 (2003).

Goh, Chang, Jang and Han, A New Pixed Circuit for Active Matrix Organic Light Emitting Diodes, IEEE Electronic Device Letters, 23, No. 9 (Sep. 2002).

Hanori, Kuroki and Kanicki Analog-Circuit Simulation of the Current-Programmed Active-Matrix Pixel Electrode Circuits Based on Poly-Si TFT for Organic Light-Emitting Displays, AM-LCD, pp. 223-226 (2001).

Yi He, Reiji Hattori and Jerzy Kanicki, Current-Source a-Si:H Thin Film Transistor Circuit for Active-Matrix Organic Light-Emitting Displays, IEEE Electron Device Letters, vol. 21, No. 12 (Dec. 2000).

Kageyama et al., A 3.5-inch OLED Display using a 4-TFT Pixel Circuit with an Innovative Pixel Driving Scheme, SID Symposium Digest of Technical Papers, 34, pp. 96-99 (May 2003).

Kim et al., 200 dpi 3-a-Si:H TFTs Voltage-Driven AM-LEDS, SID 03 Digest (Society for Int. Display), pp. 18-21 (2003).

JH Lee, WH Nam, SM Han, MK Han , OLED Pixel Design Employing a Novel Current Scaling Scheme, SID International Symposium Digest of Technical Papers, pp. 490-493 (2003).

Kwan Hee Lee, Seoung- Yoon Ryu, Jung Hyuk Kwon, Sang Wook Kun, and Ho Kyoon Chung: 2.2 QCIF Full Color Transparent AMOLED Display, SID Symposium Digest of Technical Papers, 34, Issue 1, pp. 104-107 (May 2003).

J. Lih, C.-F. Sung, M. S. Weaver, M. Hack and J. J. Brown, "A phosphorescent active-matrix OLED display driven by amorphous silicon backplane," *Proc. SID*, vol. 34, No. 1, 14 (2003).

Lin et al., A novel current memory circuit for AMOLEDs, Electron Devices, IEEE Transactions, 51, Issue 6, pp. 1037-1040 (Jun. 2004).

B. Mazhari, Yogesh S. Chauhan Dept., A New Negative Feedback based Poly-Silicon AMOLED Pixel Circuit With Highly Linear Transfer Characteristics, Indian Institute of Tecknology (IIT) Kanpur, India-208016 (2003).

Park et al., Active Matrix OLED Displays Using Simple Poly-Si TFT Process, SID International Symposium Digest of Technical Papers, 2003—Society for Information Display. 34; No. 1. pp. 487-489 (2003).

James L. Sanford and Frank R. Llbach, TFT AMOLED Pixel Circuits and Driving Methods, SID Symposium Digest of Technical Papers—May 2003—34, Issue 1, pp. 10-13 (2003).

Tai et al., A New Pixel Circuit for Driving Organic Light-Emitting Diode with Low Temperature Polycrystalline Silicon Thin-Film Transistors, IEEE//OSA Journal of Display Technology, vol. 1, No. 1 (Sep. 2005).

Tam et al., Polysilicon TFT Drivers for Light Emitting Polymer Displays, 1999 IDW '99, Sendai Int. Center, Sendai, Japan (1999).

Shoji Terada et al., A 24-inch AM-OLED Display with XGA Resolution by Novel Seamless Tiling Technology. SID 2003 Digest, pp. 1463-1466 (2003).

Tsujimura et al., A 20-inch OLED Display Driven by Super-Amorphous-Silicon Technology, SID International Symposium Digest of Technical Papers, 34.pp. 6-9 (2003).

Kwak et al., A 50-in WVGA AMOLED Display for PDAs, SID Symposium Digest of Technical Papers. pp. 100-103 (2003).

Ohta et al., A Novel Current Programmed Pixel for Active Matrix OLED Displays. SID Symposium Digest of Technical Papers 34, pp. 108-111 (2003).

Yujuan et al , A Simple and Effective Pixel Driving Circuit for Active Matrix OLED, IEEE Transactions on Electron Devices; 50. pp. 1137-1144, Part 4. (2003).

Dawson et al., The Impact of the Transiont Response of Organic Light Emitting Diodes on the Design of Active Matrix OLED Displays, Electron Devices Meeting. 1998. IEDM '98 Technical Digest., International,pp. 875-878 (Dec. 1998).

Goh et al., A New a-Si:H Thim-Film Transistor Pixel Circuit for Active-Matrix Organic Light-Emitting Diodes, Electron Device Letters, IEEE, 24, Issue 9, pp. 583-585 (Sep. 2003).

Hattori, Data-Line Driver Circuits for Current-Programmed Active-Matrix OLED Based on poly-Si TFTs, International Workshop on AMLCD digest, p. 1. AM-LCD 2002. Kogakuin University, Tokyo, Japan (Jul. 10-12, 2002).

Ashtiani et al., A Driving Scheme for AMOLED Displays Based on Current Feedback, IEEE 2006 Custom Integrated Circuits Conference (CICC), Sep. 1, 2006, Piscataway, NJ, pp. 289-292.

* cited by examiner

ACTIVE MATRIX DISPLAY AND METHOD

BACKGROUND OF THE INVENTION

The present invention relates to an active matrix display and method to drive the display.

Active matrix displays are formed of many light emitting units called pixels. Each pixel includes an electronic circuit that controls a light emitting diode. The pixels are arranged in an array of rows and columns to form a display. In operation, each pixel of an array is sequentially programmed with an updating data value that is transformed into a light level.

In a typical 2-TFT pixel, the data value that determines light intensity is provided externally in the form of a voltage. The voltage is transformed by the pixel circuit into a current that is directed to the organic light emitting diode (OLED). The amount of current determines an amount of diode emitted light. As an OLED is programmed, a thin film transistor (TFT) transmits a data value voltage from a program line to a gate of another transistor that regulates current that flows to the OLED from a power supply.

The current that flows through the current regulating transistor depends on the voltage at its gate. Factors such as the transistor material properties have a direct affect on current flow through a transistor. Transistor material property variations (mismatch) can result in a different current for the same programmed voltage level to two different pixels. This in turn results in a difference in light output. Various pixel designs have been proposed with increased number of transistor and control lines to address this problem. However, these designs are complex structures with reduced yield and aperture ratio.

There is a need for an active matrix display that includes a pixel driver with improved output uniformity that utilizes a minimum of transistors, avoids complex pixel circuitry and that can be rapidly programmed.

BRIEF DESCRIPTION OF THE INVENTION

The invention provides an active matrix display with a display driver control circuit that produces high levels of uniformity without increasing display pixel complexity.

The invention can be described as a display comprising: a plurality of pixels and a data line, a select line and a current line for the pixels, at least one pixel comprising a circuit with at least two thin film transistors, a capacitor and a light emitting diode; and a circuit, external to the plurality of pixels that adjusts voltage of the data line according to drawn current from a power supply signal to the display.

In an embodiment, the invention is an active matrix display comprising: at least one data driver circuit comprising a column data line and a column current: line; a plurality of pixels connected to both the column data line and the column current line comprising at least one pixel that is responsive to a column data line voltage to drive a pixel current to the at least one pixel; and a loopback circuit at the head of the column data line and column current line and external to the plurality of pixels and which senses a voltage of the driven pixel current and adjusts a column data line voltage to program a voltage of an adjusted pixel current to match an external reference current.

In another embodiment, a method to drive an active matrix display comprises: sensing a voltage difference between a voltage of a current drawn by a programmed pixel and a voltage of a first power supply current to the active matrix display; and adjusting a data programming voltage to a pixel of the display according to the difference; wherein the sensing and adjusting are conducted by a loopback control circuit at a head of a column of pixels that includes the pixel and external to the pixels of the column.

In another embodiment, an active matrix display comprises: a plurality of AMOLED pixels arranged in matrix columns and rows, wherein each column of pixels is connected to a common current line and to a common data voltage source and each row of pixels is connected to a common select line, wherein the at least one pixel comprises: a current drive transistor having a drain/source, gate and a source/drain connected to the column current line; an address transistor having a source/drain connected to the gate of the drive transistor and a drain source connected to the column data line; a select line connected to the gate of the address transistor; and an OLED connected to the drain/source of the current drive transistor; wherein the plurality of AMOLED pixels is connected to a loopback control circuit at the head of at least one of the columns and external to the plurality of pixels of that column and that senses a voltage of a driven pixel current and adjusts a column data line voltage to program a voltage of an adjusted pixel current to match an external reference current.

In still another embodiment, the invention is a data driver circuit comprising: at least one column data line; at least one parallel column current line; a plurality of pixels connected in series to both the at least one column data line and a corresponding parallel column current line, comprising at least one pixel that is responsive to the column data line to drive a pixel current to the at least one pixel; and a loopback control circuit at the head of a column of a data line and a current line and external to a plurality of pixels of the column that senses a voltage difference between a voltage of a first input data current and a voltage of a load drawing on the current line and that adjusts the input data current according to the difference.

In another embodiment, a method to drive an active matrix display comprises: (A) sampling an initial current that represents a first program data value from a power supply to an active matrix display; (B) storing the same first program voltage data value at a second capacitor circuit and applying the first program voltage data value to the selected pixel circuit; (C) drawing a current according to a next voltage data value that is reduced from the applied first program voltage data value as a result of pixel property variations; (D) sensing a voltage of the drawn current and comparing it to a voltage of the sampled initial current signal; (E) adjusting the first program voltage data value to a new program voltage data value at the second capacitor according to the comparing; (F) applying the new program voltage data value to the selected pixel; and (G) repeating (B) through (F) until a compared stored program voltage data value is the same as a voltage of the sampled initial current.

DETAILED DESCRIPTION OF THE INVENTION

The brightness of an AMOLED display in part depends on current through the OLED elements. Each pixel circuit in an AMOLED element is programmed to drive a desired current by applying a voltage to circuit transistors for a voltage-programmed pixel or by applying a current to differently configured, circuit transistors for a current-programmed pixel.

In a voltage-programmed display, voltage-to-current conversion is based on a transistor's large signal transconductance, a quantity that represents a ratio of current-output to voltage-input. OLED element current varies with the transconductance of a pixel circuit transistor. Transconductance depends on factors such as transistor mobility, which can vary across a display thereby creating nonuniformity, both within a display and from display to display. In addition, voltage programmed pixels can have sensitivity to transistor threshold voltage, which also varies across the display and from display to display.

The invention relates to a data driver circuit that reduces active matrix backplane complexity and that improves AMOLED performance compared to more complex uniformity correction mechanisms. A driver is a programming circuit or sequence of instructions that control a display. In an embodiment, the invention provides a data driver for a 2-TFT pixel that produces high levels of uniformity without the need for an increased number of pixel transistors or control lines. The data driver operates inside a feedback loop formed by the data line and the current line in each column or for a plurality of columns. A switching circuit, discriminates an individual pixel current from the rest of the column current in the current line. Then, a current-sense circuit controls the feedback loop that charges the data line until a desired level of pixel current is reached.

Features of the invention will become apparent from the drawings and following detailed discussion, which by way of example without limitation describe preferred embodiments of the invention. In the figures, like structures are identified by the same numbers.

Figure 1:
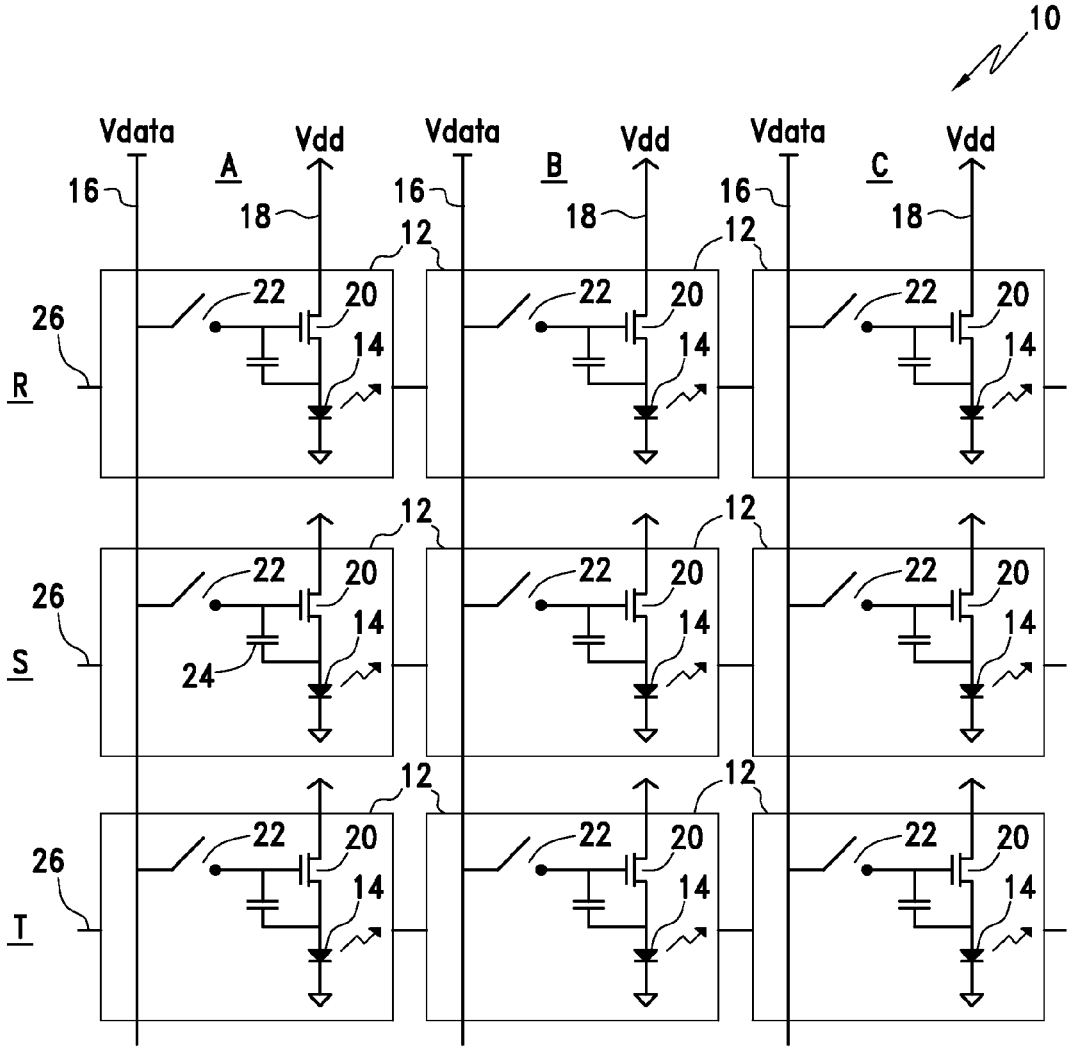
FIG. 1 is a schematic representation of a display circuit.

FIG. 1 is a schematic representation of the proposed AMOLED display circuit 10. The circuit 10 includes a plurality of pixels 12 arranged as a matrix array. FIG. 1 shows a 3×3 matrix that is only representative of AMOLEDs that can be formed of thousands of the light emitting pixels 12. The 3×3 matrix is shown as including columns A, B and C and rows R, S and T. Each pixel 12 is provided between a crossing of a pixel select line 26 and a pair of a column data line 16 and a column current line 18. Each of the pixels 12 includes an electronic circuit that controls a light emitting diode 14.

Each column includes a data line 16 and a current line 18 and each pixel circuit includes transistor M1 20 and transistor M2 22 and a storage capacitor 24. The transistors 20 and 22 are three terminal devices (gate, drain and source) that can act in two manners: as a switch that allows information to pass through in the form of a voltage, or as a variable valve that controls amount of flowing current. In each pixel 12, transistor M1 20 is a current drive transistor having a drain/source connected to the column current line 18, a source/drain coupled to diode 14 and a gate coupled to the source of the transistor M2 22. Address transistor M2 22 has a source/drain connected to the gate of the drive transistor M1 20, a drain/source connected to the column data line 16. Address transistor M2 22 functions as a switch; when the switch is ON, voltage on its drain is passed through to the source; when the switch is OFF no voltage is allowed to be transmitted. Transistor M1 20 functions as a regulating valve that can control the flow of current depending on the state of its gate. As a general rule, the amount of voltage on the gate of transistor M1 20 determines the current that flows through the device (into the drain and out from the source.)

When a column of pixels A, B or C is updated with new information, data line 16 supplies a data value in the form of a voltage. This is done one row at a time with each pixel 12 in a row simultaneously provided with its corresponding data value. The voltage is transformed into a current by transistor M1 20 and provided by the current line 18. The current is directed to the light emitting diode with the amount of current determining an amount of emitted light. Data to an AMOLED is written one row at a time into the pixel, but diodes are operated at an essentially 100% duty cycle. This is accomplished by providing a memory circuit for each pixel provided via the combination of transistor 22 and a capacitor 24.

In operation, a select line 26 is pulsed to select a pixel 12. The transistor M2 22 is activated by the select line 26 pulse and is turned to an ON position (shown in FIG. 3). In a conventional display, while the selected pixel is charged to a stable voltage through the program line 16, new current I is drawn from the column current line 18. Since all other pixels 12 are non-selected, the new current I flows through the selected pixel.

The current that flows through a transistor depends on the voltage at its gate. However, material properties of the transistors that form the array of pixels can vary significantly across a display area. These factors create non-uniform brightness levels. Hence, light output will be different for two different pixels even with the same programmed voltage level. Variations in properties of the pixels can result in mismatches throughout a device display.

The invention provides an external control circuit for a display. The control produces high levels of uniformity without increasing the display pixel complexity. The invention can result in displays with higher aperture ratio (brighter displays), lower OLED operating voltages, lower power consumption, higher yield and lower production cost. The invention driver can be implemented in standard ICs or integrated on the same panel as the active backplane, further reducing display costs.

Figure 2:
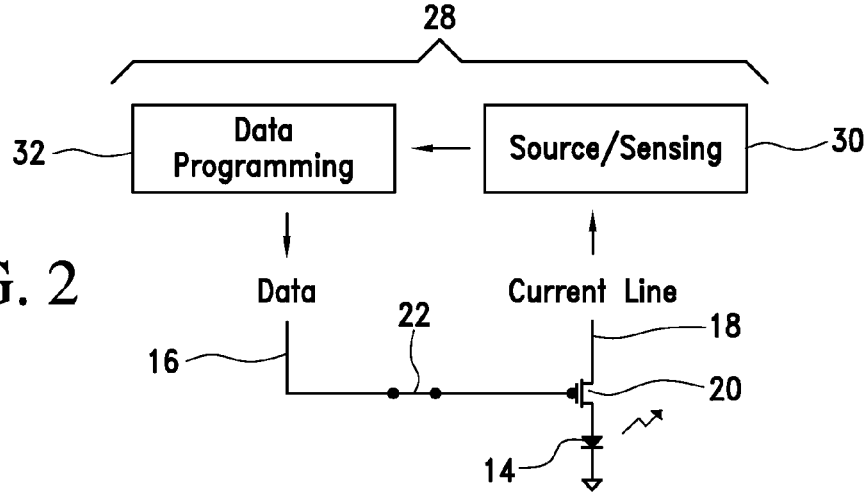
FIG. 2 is a diagrammatic illustration of a display circuit.
Figure 3:
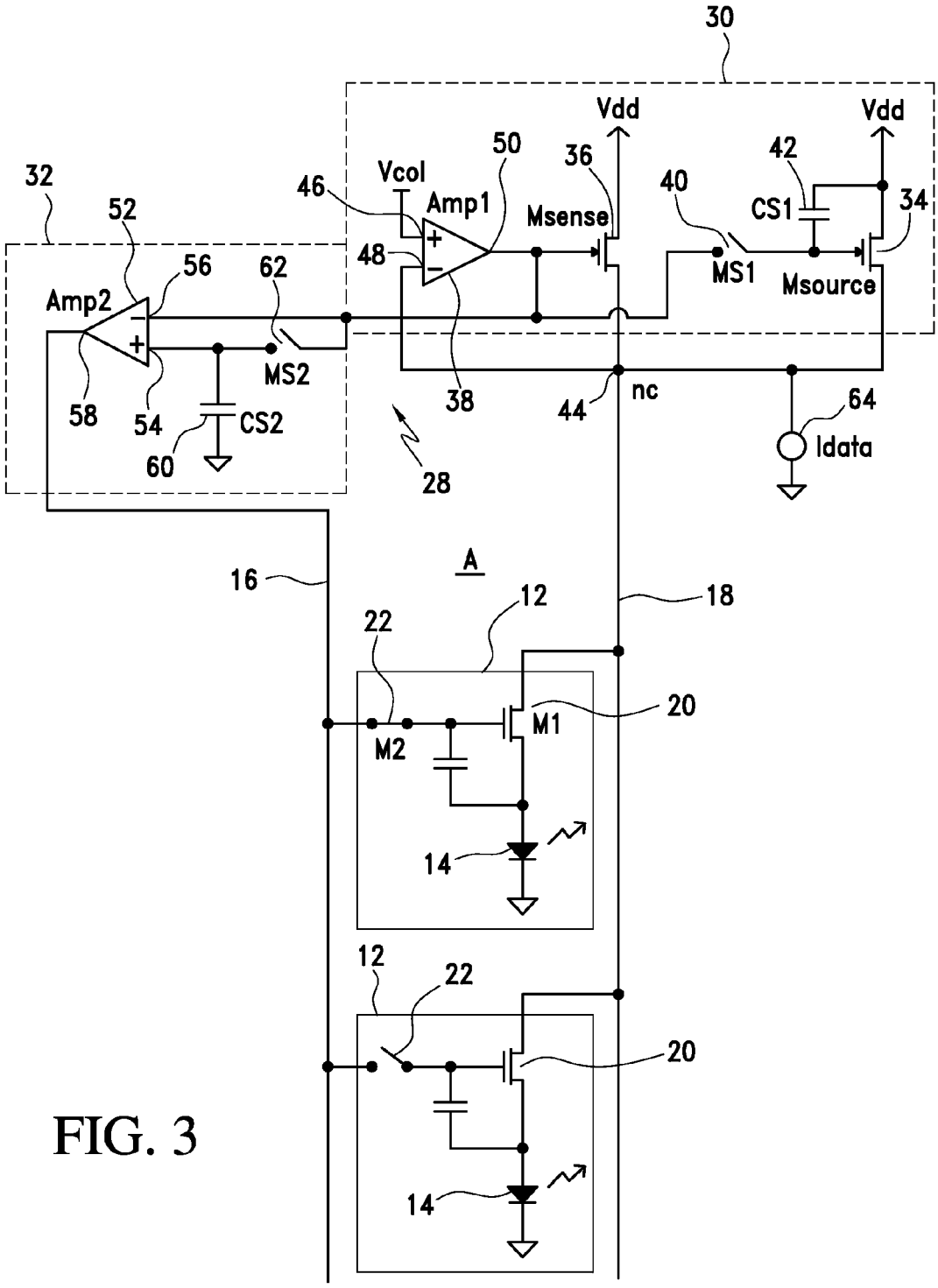
FIG. 3 is a schematic representation of a display circuit.

FIG. 2 diagrammatically illustrates an external control circuit 28 of the invention poised in combination with internal pixels 12. The internal circuit of pixel 12 includes transistors 20 and 22 and light emitting diode 14. The external control circuit 28 operates inside a feedback loop formed by the data line 16 and the current line 18 at the head of each display circuit column, for example A. In FIG. 2 and FIG. 3, external control circuit 28 includes source/sensing module 30 in combination with data programming module 32.

In operation, the source/sensing module 30 discriminates an individual pixel current from the rest of the column current in the current line 18 and controls the internal feedback loop to control programming module 32 to attain a target level of pixel current. Because current sensing and control are performed at the driver column head and not within the pixel 12, material mismatch characteristics of the pixel transistors 20, 22 are not adverse factors. Further, since the same external control circuit 28 is used to program all pixels in a given column, pixel current variation is minimized.

FIG. 3 is a schematic circuit diagram of one display according to the invention, including external control circuit 28. In this application, "external control circuit" means a control circuit relating or connected outside of pixels of an array. For example, the external control circuit can be located within a display circuit, at the head of a pixel column. In an array, each pixel column can be associated with its separate external control circuit. In FIG. 3, source/sensing module 30 includes transistor MSource 34, transistor MSense 36 and amplifier Amp 1 38. Transistor MSource 34 is a transistor that supplies current at low voltage; transistor MSense 36 is a transistor that senses small current change; amplifier Amp 1 38 controls both transistors 34, 36. The FIG. 3 shows a single source/sensing module 30 with a data programming module 32 in combination with a single display column. However as pointed out above, a source/sensing module 30 and data programming module 32 combination is associated at the head of each of a plurality of columns of a display matrix.

The FIG. 3 current source/sensing module 30 provides a control mechanism by means of amplifier Amp1 38, transistor MSense 36 and Msource 34. Amplifier Amp1 38 has three terminals; two voltage input terminals 46, 48 labeled as '+' and '−' and an output terminal 50 that controls the gate of transistor MSense 36 and transistor Msource 34. Input terminal 46 is connected to constant externally applied voltage Vcol. Input terminal 48 is connected to node nc 44. Node nc 44 stays constant at voltage Vcol except for small variations during programming. When switch MS1 40 is ON, transistor MSense 36 and transistor Msource 34 gate voltages are established by a current, that flows through transistors MSense 36 and Msource 34 in response to current line 18. When the line 18 starts drawing more current, the node nc 44 and correspondingly input terminal 48 voltage change. Hence in response to any node nc 44 voltage change, amplifier Amp1 38 regulates MSense transistor 36 and Msource transistor 34 gate voltage to regulate current voltage through transistors MSense 36 and Msource 34. The resulting change in the voltage at output terminal 50 changes the gate of transistor MSense 36 and Msource 34 until the current supplied by both transistors matches the drawn current.

The change in voltage at the gate of transistor MSense 36 is directly related to the size of the transistor. A larger transistor can produce more current with a small change in gate voltage. On the other hand, a smaller transistor can more accurately control its output current by requiring a larger voltage change at its gate (for a given small change in current).

In the FIG. 3 current source/sensing module 30, a larger transistor MSource 34 and the smaller transistor MSense 36 can be sized to meet specific display requirements. They are connected through a switch MS1 40 and are controlled by the amplifier Amp1 38. The element 'A' represents one display column. When operation starts, switch MS1 40 is ON and most of the column current flows through the large transistor MSource 34 (at this point, no current flows through a selected pixel). When switch MS1 40 is turned OFF, voltage in the gate of large transistor MSource 34 stays constant per capacitor CS1 42 and hence, current supplied by larger transistor MSource 34 also stays constant. This operation is referred to as column current sampling by transistor MSource 34.

The FIG. 3 data programming module 32 is connected to the current source/sensing module 30. The data programming module 32 comprises amplifier Amp2 52 and a series of switches. The amplifier Amp2 52 has one input 54 connected to a capacitor CS2 60 and another input 56 connected to the gate of MSense transistor MS1 36. Another output terminal 58 is connected to the data line 16 of column A. In a second sampling period, switch transistor MS2 62 samples voltage at the gate of the smaller MSense transistor 36 and stores it in the capacitor CS2 60 (this sets a base level that is indicative of column current and will be used in a later comparison step). At this stage, the current source/sensing module 30 is on standby/sensing mode and MSense 36 is sensing change in column current flowing into the node nc 44. Amplifier Amp2 52 can adjust voltage at the gate of MSense transistor 36 accordingly.

During a programming period, data line 16 is connected to the gate of transistor M1 20 through transistor M2 22. Transistor M1 20 is always connected to node nc 44. This configuration provides a feedback loop comprising current source/sensing module 30, data programming module 32 and pixel transistor M1 20 through current line 18 at node nc 44 and data line 16. When an external data current Idata 64 is injected into node nc 44, the following mechanism takes place in the feedback loop: (i) a gate voltage of MSense 36 is changed by Amp1 38 to accommodate the node nc 44 drawn current; (the current is sensed); (ii) the negative input voltage of Amp2 52 changes with respect to the positive input 54 to increase voltage at output terminal 58 of Amp2 (the injected current is compared to current through transistor M1 20; which initially is zero value); (iii) output from Amp2 (connected to data line 16) changes the voltage of the gate of transistor M1 20 (data line 16 is adjusted according to the comparison difference); and (iv) current drawn by transistor M1 20 through node nc 44, correspondingly increases. The (i) through (iv) mechanism is repeated until an equivalence is attained where current drawn by transistor M1 20 through node nc 44 matches the injected data current Idata 64 (no difference is sensed in the comparison step (ii)). The current drawn by M1 20 matches the injected current, bringing the two terminals 56, 54 of Amp2 52 to the equivalence. At the equivalence, voltage at the gate of MSense 36 is back to an original value The feedback loop reaches the equivalence to provide a correct value for the pixel current.

The following Examples are illustrative and should not be construed as a limitation on the scope of the claims unless a limitation is specifically recited.

EXAMPLES

For purposes of this application, the mobility of a transistor is a device property that quantifies the amount of current a transistor of a certain size can provide. In other words for a given gate voltage, the amount of current that flows is a function of its mobility (among other factors). For example, if the same voltage is applied at the gates of two transistors of the same size, but one with 20% higher mobility, then the higher mobility transistor will provide 20% more current (all other factors being equal). Mobility is a function of material properties and device fabrication and for the technologies used to fabricate displays it can vary throughout the display area.

For all purposes of this application, the threshold voltage of a transistor is the minimum voltage required at the transistor gate for current to flow. Threshold voltage is a function of material properties and device fabrication and as a result, threshold voltage can vary throughout a display area.

Example 1

A circuit simulation was performed with PSPICE® computer software. PSPICE® is computer software for analog and mixed analog/digital circuit simulation and is provided by ORCAD, Inc., 2655 Seely Avenue, San Jose, Calif. 95134 through EMA Design Automation, Inc., PO Box 23325, Rochester, N.Y. 14692. PSPICE® software accepts user input circuit schematics and transistor models and addressing information and generates a simulated response.

Figure 4:
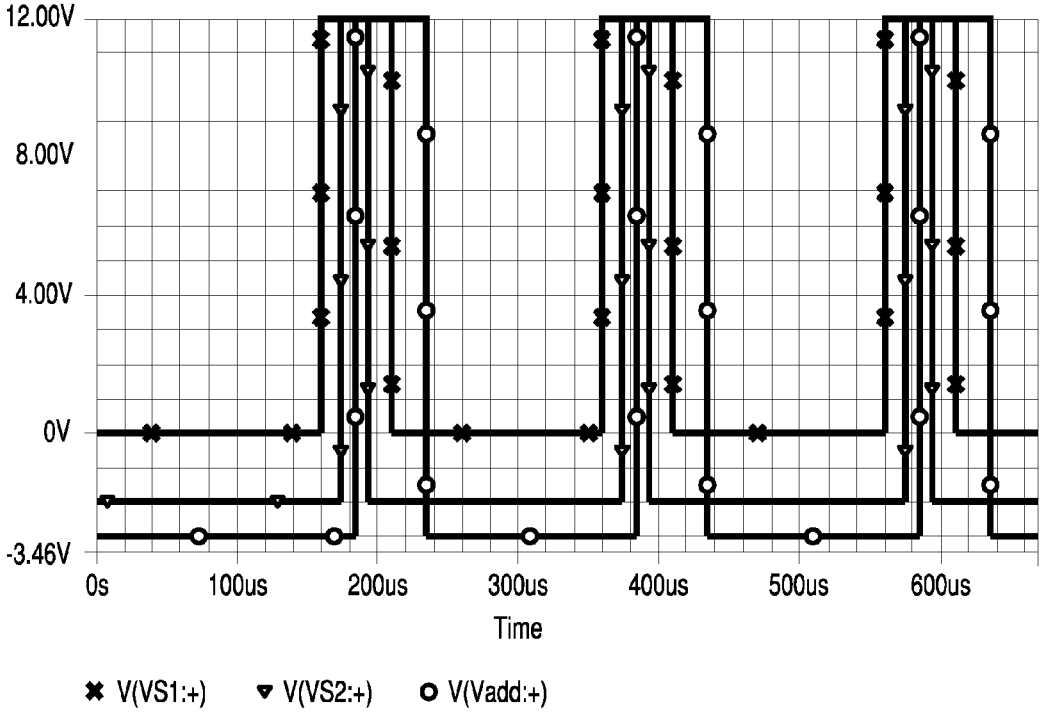
FIG. 4 and FIG. 5 are graphs of current at a pixel and currant at a driver.

A circuit schematic was PSPICE® simulated to substantially match the FIG. 2 and FIG. 3 circuits. The signals represented in FIG. 4 are the control signals that activated the different switches in the display driver; in particular, the voltage signals that controlled MS1, MS2 and transistor M2 in the pixel being programmed. The FIG. 5 output graph represents current though the programmed pixel as a function of time as well as the data current as a function of time (Idata 64 feed to node nc of the display driver).

Simulated system variables included the following: (1) total column current, the sum of all the pixel currents in a given column, varied from a 150 μA to 3500 μA; (2) pixel data current was varied from 0.3 μA to 20 μA; (3) pixel transistor M1 was varied iii different sizes to emulate mobility changes of up to 25%; and (4) pixel transistor threshold voltage was varied by connecting voltage sources to the gate of M1 to simulate changes of up to 50% in threshold voltage.

Figure 5:
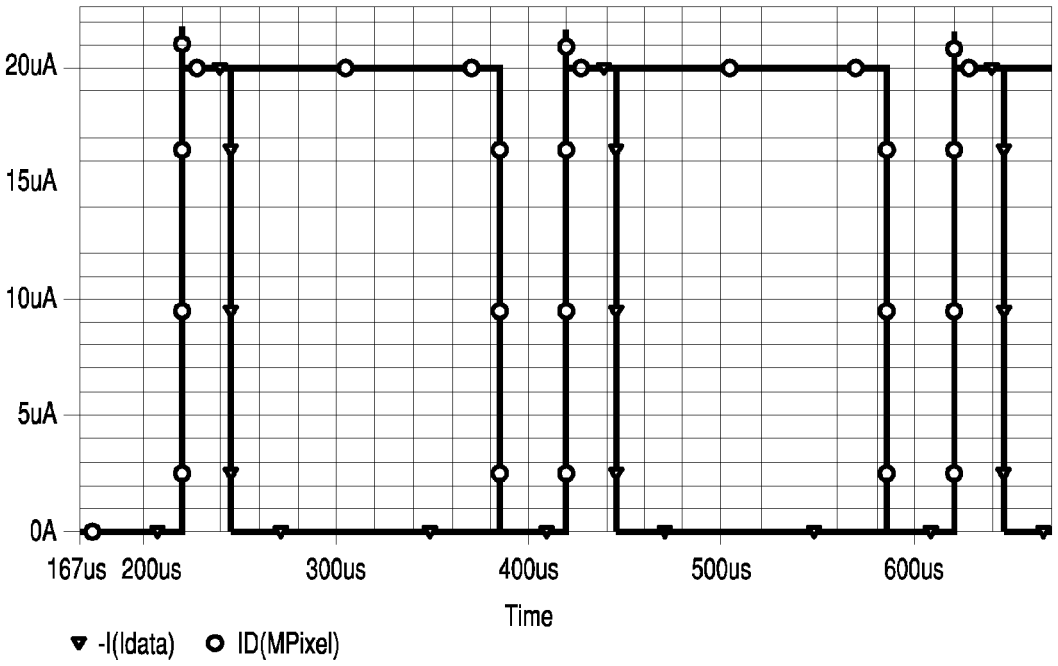

The FIG. 5 plot, shows how pixel current matches data current. This simulation was performed under several system conditions to show the display driver performing required operation for a range of conditions.

FIG. 5 shows that the proposed display driver programmed a desired level of current into the intended pixel under all the system variables described above. The simulations results establishes that the circuit can perform pixel addressing with current mismatch correction as intended at required operation speeds and current demands. A qualitative representation of accuracy can also be extracted from the simulation results.

Example 2

The following EXAMPLE was set up to compare programming of data current in display pixels with drive transistors, M1 with different properties and to demonstrate this function at different column current levels.

A display driver for a display column was fabricated in single crystal silicon integrated circuits (ICs). The column included test pixel circuits implemented in the IC as well. The test pixel circuits were fabricated to have identical properties except for M1 transistor size. Two pixels were fabricated with a size difference of 20% in the width of M1 to emulate 20% mobility differences. In order to emulate threshold voltage variations, an external v voltage source was connected to the pixel. This voltage source represented a change of 25% to the threshold of transistor M1.

In the procedures, LabVIEW® computer software was used to apply circuit voltages. LabVIEW® computer software is used to control and emulate scientific and engineering instruments and instrumentation systems and to perform instrumentation functions. In a first procedure, a voltage level was established in a program line of each of two pixels, which was then, transformed to a current by M1. The following conditions were varied to prove performance: (1) total column current was varied from 150 μA to 3000 μA; (2) pixel data current was varied from 0.5 μA to 15 μA; (3) mobility of pixel transistor M1 was varied by varying size up to 20% change; and (4) threshold voltage of pixel transistor M1 was varied by introducing voltage sources of up to 25% change.

Figure 6:
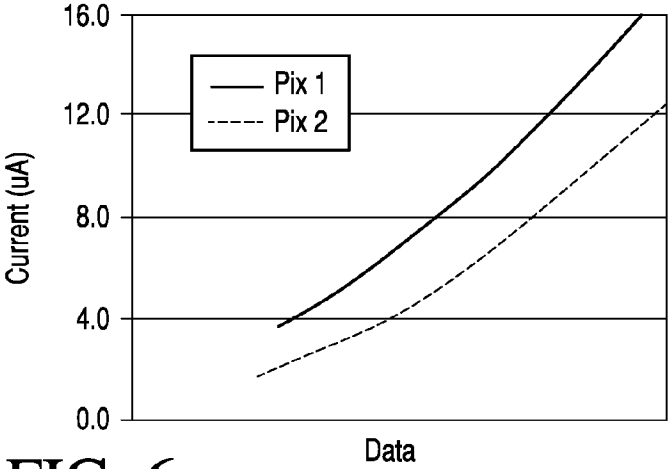
FIG. 6 and FIG. 8 are graphs showing current, relationship with data.

FIG. 6 shows current flow through the two pixels (Pix1 and Pix2) when they are programmed in a typical prior art manner. FIG. 6 shows threshold voltage raised, by 25%> (Pix1) and mobility raised by 20% (Pix2). For example at low data levels, Pix1 provided about 2.5 μA; however, at the same data level, Pix2 provided about 4 μA. This difference would result in difference in brightness in the display, even though both pixels were intended to have the same intensity level (as intended by the same data levels).

Figure 7:
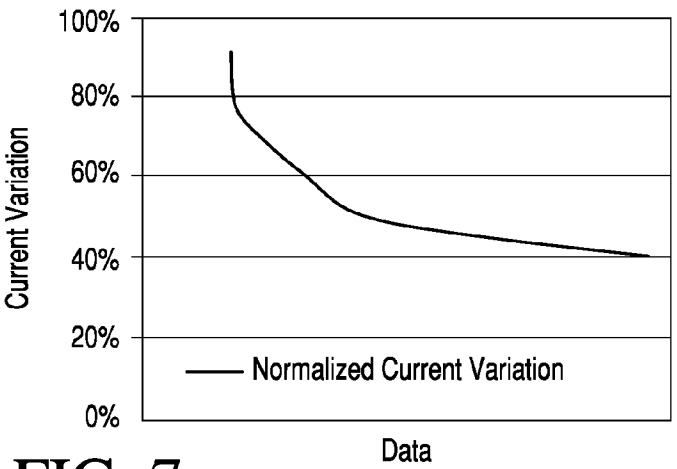
FIG. 7 and FIG. 9 are graphs of current, percentage mismatch as a function of data.

The plot of FIG. 7 represents the normalized percentage change between the two pixels as a function of data voltage.

The FIG. 6 and FIG. 7 establish degree of current change with changes in M1 properties.

Figure 8:
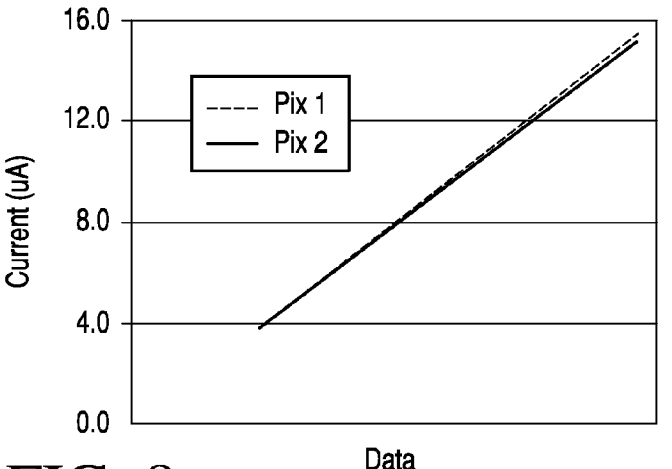
Figure 9:
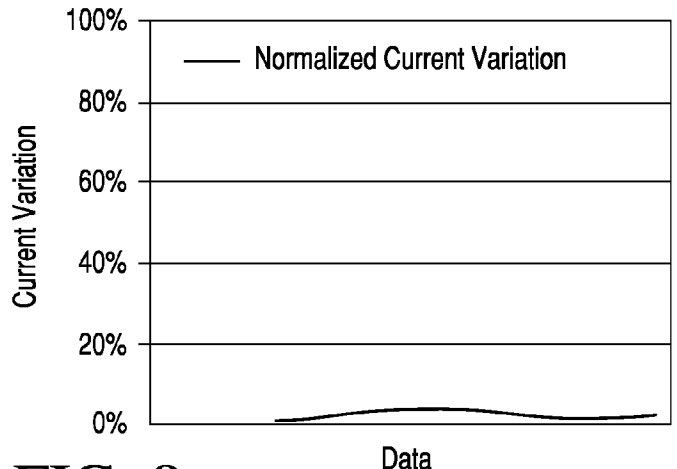

FIG. 8 shows current through the same two pixels but programmed with the FIG. 3 display driver. FIG. 8 shows the resulting two currents matched perfectly even though the transistors M1 had varying properties. The FIG. 9 normalized percentage plot shows only a measuring tolerance variation between, the two pixel currents.

The experimental data establishes that non-uniformity is reduced from 70% to below 3% for two pixels driven with the standard technique and adjusting driver of the invention respectively. This uniformity level is improved to an order of magnitude throughout an entire data range. Further, simulations established that programming time can be reduced below the time required by a typical prior art current-copy pixel.

The inventive data driver can be implemented in standard ICs or on the same panel as the active backplane. Poly-silicon TFTs offer a good compromise between performance and cost for the proposed driver.

The inventive circuit reduces complexity of active matrix backplanes by providing uniformity levels with lower complexity than those of typical prior art correction techniques in connection with two transistors TFT pixels. And, since the performance requirements on the transistors on a backplane have been reduced, lower cost technologies can be used for the large area array.

While preferred embodiments of the invention have been described, the present invention is capable of variation and modification and therefore should not be limited to the precise details of the EXAMPLES. The invention includes changes and alterations that fall within the purview of the following claims.

What is claimed is:

1. A display, comprising:

a plurality of pixels, wherein each of the plurality of pixels is operably connected to a data line, a select line, and a current line, at least one pixel comprising two thin film transistors each transistor comprising a source, a drain and a gate, a first transistor having a gate connected to the select line and a source or drain connected to the data line; a second transistor having a gate connected to the drain or source of the first transistor and a drain or source connected to the current line, a capacitor, and a light emitting diode;

a circuit external to the plurality of pixels, the circuit configured to actively control a current value for each of the pixels by adjusting a voltage of the data line according to drawn current from the current line such that a desired pixel current is set to be drawn from the current line by one of the transistors;

wherein the circuit external to the plurality of pixels adjusts the voltage of the data line according to drawn current from the current line and wherein the circuit external sets the desired pixel current within a single pixel addressing period determined by the select line activating another one of the transistors;

and wherein the circuit external actively controls and sets the desired pixel current while the current line concurrently provides current to other illuminated pixels connected to the same current line.

2. The display of claim 1, wherein the circuit external does not require any processing of measurement data through any software or algorithm to actively control and set the desired pixel current value.

3. The display of claim 1, wherein the circuit external sets each desired pixel current as a result of data line voltage adjustments, and wherein the data line voltage adjustments are a result of current line current changes occurring during each pixel addressing period.

4. The display of claim 1, wherein the circuit external to the display is connected to a data line and a current line; and wherein the plurality of pixels connected to both the same data line and the same current line comprise at least one pixel that is responsive to the data line to set a desired pixel current to the at least one pixel; wherein the circuit external to the plurality of pixels samples the current of the current line, senses the current of the pixel, compares the current with an external data current and adjusts the data line voltage to set the desired pixel current.

5. The display of claim 1, wherein the one circuit external to the display is connected to a data line and a current line; and wherein the plurality of pixels is connected to both the same data line and the same current line and comprises at least one pixel that is responsive to the data line to set a desired pixel current to the at least one pixel; and wherein the circuit external to the plurality of pixels samples the current of the current line, senses the current drawn by the at least one pixel, compares the current drawn by the at least one pixel with an external data current and adjusts the data line voltage according to the difference and repeats a loopback circuit operation until no difference is sensed when the value of the sensed current drawn by the at least one pixel is compared with the value of the external data current.

6. The display of claim 1, wherein the circuit external to the display is connected to a data line and a current line; and wherein the plurality of pixels connected to both the same data line and the same current line comprises at least one pixel that is responsive to the data line to set a desired pixel current to the at least one pixel; and wherein the current line is connected to a pixel current drive transistor source/drain and the column data line is connected to a pixel address transistor source/drain.

7. The display of claim 1, wherein the circuit external to the display comprises a plurality of loopback circuits each connected to a data line and a current line; and a plurality of pixels connected to both the same data line and the same current line comprising at least one pixel that is responsive to the data line voltage to set a desired pixel current to the at least one pixel; and wherein for each loopback circuit connected to the same data line and the same current line of said plurality of pixels, the loopback circuit is configured to sequentially control, and set a voltage for each pixel connected to the said data line so that each pixel draws a desired current from said current line.

8. The display of claim 1, wherein the plurality of pixels consist of columns of pixels, and wherein each column comprises a plurality of pixels connected to a column data line and a column current line, and wherein each circuit external comprises at least one loopback circuit operably connected to each of the column data lines and column current lines, the loopback circuit configured to determine a current at each pixel and to adjust a column data line voltage to program a voltage of an adjusted pixel current until the adjusted pixel current matches an external reference current.

9. The display of claim 8, wherein the at least one loopback circuit samples a current from a current line, senses the driven pixel current, compares the driven pixel current with the external reference current and adjusts the column data line voltage to drive an adjusted pixel current according to the difference and repeats loopback circuit operation until no difference is sensed when the driven pixel current is compared with the external reference current.

10. The display of claim 8, wherein the at least one loopback circuit further includes a comparator that compares a voltage related to an active drawn level of the pixel current with a stored level of the pixel current and an adjuster that adjusts a voltage of the column data line according to the comparison with a reference current.

11. The display of claim 8, wherein the at least one loopback control circuit comprises a current source and sensing module comprising an amplifier with an input terminal connected with a constant voltage source and an input terminal connected with a source transistor and an output terminal switchably connected to the gate of a source transistor and a sense transistor, wherein when a switch is ON, the amplifier activates the source transistor to sample a column current or when the switch is OFF, adjusts voltage on the sense transistor in response to a difference between current at the sense transistor and an external reference data current.

12. The display of claim 8, wherein the at least one loopback control circuit comprises a data programming module comprising an amplifier connected between a sense transistor and a stored level of the pixel current and that adjusts the column data line voltage in response to a difference between a sense transistor voltage and a stored level of the pixel current.

13. The display of claim 8, wherein the loopback control circuit comprises:

a current source and sensing module comprising an amplifier with an input terminal connected with a constant voltage source and an input terminal connected with a source transistor and an output terminal connected to the gate of a switchable source transistor or sense transistor, wherein when a switch is ON, the amplifier activates the source transistor to sample a column current or when the switch is OFF, adjusts voltage on the sense transistor in response to a difference between current at the sense transistor and an external reference data current; and a data, programming module comprising an amplifier connected between a sense transistor and a stored level of the pixel current and that adjusts the column data line voltage in response to a difference between a sense transistor voltage and an stored level of the pixel current.

14. The display of claim 8, wherein at least one pixel is provided between each crossing of a pixel select line and a pair of a column data line and a column current line and wherein the pixel comprises an ON/OFF transistor that provides selected voltage through the column data line and a transistor that regulates current in the column current line to the light emitting diode in response to activation by the ON/OFF transistor.

15. The display of claim 8, wherein at least one of the plurality of pixels comprises a 2-TFT pixel circuit, wherein a first transistor comprises a source coupled to receive a data signal, a gate coupled to receive a select signal and a drain coupled to a gate of a second transistor and the second transistor comprises a drain and source to transmit a current when the second transistor is activated.

16. The active matrix display of claim 8, wherein, the at least one loopback control circuit comprises:

a current source and sensing module comprising an amplifier with an input terminal connected with a constant voltage source and an input terminal connected with a source transistor and an output terminal connected to the gate of a switchable source transistor or a sense transistor, wherein when a switch is ON, the amplifier activates the source transistor to sample a column current or when the switch is OFF, adjusts voltage on the sense transistor in response to a difference between current at the sense transistor and current drawn by a load at the column current line; and a data programming module comprising an amplifier connected between a source transistor and a sense transistor and that adjusts the column data line voltage in response to a difference between a sense transistor voltage and stored level of the pixel current; and at least one of the plurality of pixels comprises a 2-TFT pixel circuit, wherein a first transistor comprises a source coupled to receive a data signal, a gate coupled to receive a select signal and a drain coupled to a gate of a second transistor and the second transistor comprises a drain and source to transmit a current when the second transistor is activated.

17. A display, comprising:

a plurality of pixels, wherein each of the plurality of pixels is operably connected to a data line, a select line, and a current line, at least one pixel comprising at least two transistors, a capacitor, and a light emitting diode, wherein a gate of one of the pixel transistors is connected to the select line;

a circuit external to the plurality of pixels and configured to actively control a current that a pixel draws from the current line connected to said pixel, by adjusting the voltage of the data line connected to said pixel according to the current of the current line connected to said pixel, such that a current with a desired value is set to be drawn from the current line connected to said pixel by one of the transistors;

wherein the circuit external to the plurality of pixels actively controls and sets the desired value of the current drawn by the said pixel from the current line within a time that is equal or less than a time during which the select line is maintained at a voltage that turns-on that said transistor within the said pixel, and wherein the desired pixel current value is set to be drawn by the said pixel from the current line while the current line concurrently provides current to other illuminating pixels connected to the same current line.

* * * * *